US005540181A

United States Patent [19]

Pearce

[11] Patent Number: 5,540,181

[45] Date of Patent: Jul. 30, 1996

[54] GOLF WIND INDICATOR APPARATUS

[76] Inventor: James F. Pearce, 121 Westerfield Dr., Goose Creek, S.C. 29445

[21] Appl. No.: 456,474

[22] Filed: Jun. 1, 1995

[51] Int. Cl.[6] ..... G09F 17/00

[52] U.S. Cl. ..... 116/173; 116/303; 73/170.15; 248/289.31; 40/608

[58] Field of Search ..... 116/173, 223, 116/284, 290, 294, 303, 305; 73/170.01, 170.05, 170.07, 170.11, 170.15, 861.76, 861.85; 248/145, 289.31, 417, 900; 40/608; 273/32 H; 403/102, 113

[56] References Cited

U.S. PATENT DOCUMENTS

| | | | |
|---|---|---|---|
| 2,491,176 | 12/1949 | Hammond | 73/170.15 |
| 3,049,008 | 8/1962 | Polster | 73/170.03 |
| 3,367,613 | 2/1968 | Christensen | 248/289.31 |
| 3,732,845 | 5/1973 | Istre | 116/173 |
| 4,227,406 | 10/1980 | Coffey | 73/170.03 |
| 4,574,726 | 3/1986 | Sullivan | 116/174 |
| 4,719,798 | 1/1988 | Orkin | 73/170.07 |
| 4,854,585 | 8/1989 | Koch et al. | 403/102 |
| 4,864,854 | 9/1989 | vanLeemput | 73/170.07 |
| 5,431,364 | 7/1995 | Etter | 248/514 |

*Primary Examiner*—William A. Cuchlinski, Jr.
*Assistant Examiner*—Andrew Hirshfeld

[57] ABSTRACT

A flag for indicating wind velocity and alerting surrounding golfers to a presence of an individual. The inventive device includes a mounting assembly for securing to a support portion of a golf cart or golf bag. A flag assembly projects from the mounting assembly and includes a pivotally mounted flag for indicating wind direction. A gauge assembly is interposed between the flag assembly and the mounting assembly for indicating a velocity of the wind.

6 Claims, 4 Drawing Sheets

GOLF WIND INDICATOR APPARATUS

BACKGROUND OF THE INVENTION

1. Field of the Invention

The present invention relates to indicating devices and more particularly pertains to a golf wind indicator flag for indicating wind velocity and alerting surrounding golfers to a presence of an individual.

2. Description of the Prior Art

The use of indicating devices is known in the prior art. More specifically, indicating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art indicating devices include U.S. Pat. Nos. 4,509,751; 4,864,854; 4,719,798; 4,286,463; and 4,080,826.

While these devices fulfill their respective, particular objectives and requirements, the aforementioned patents do not disclose a golf wind indicator flag for indicating wind velocity and alerting surrounding golfers to a presence of an individual which includes a mounting assembly for securing to a support portion of a golf cart or golf bag, a flag assembly projecting from the mounting assembly and including a pivotally mounted flag for indicating wind direction, and a gauge assembly interposed between the flag assembly and the mounting assembly for indicating a velocity of the wind.

In these respects, the golf wind indicator flag according to the present invention substantially departs from the conventional concepts and designs of the prior art, and in so doing provides an apparatus primarily developed for the purpose of indicating wind velocity and alerting surrounding golfers to a presence of an individual.

SUMMARY OF THE INVENTION

In view of the foregoing disadvantages inherent in the known types of indicating devices now present in the prior art, the present invention provides a new golf wind indicator flag construction wherein the same can be utilized for indicating wind velocity and alerting surrounding golfers to a presence of an individual. As such, the general purpose of the present invention, which will be described subsequently in greater detail, is to provide a new golf wind indicator flag apparatus and method which has many of the advantages of the indicating devices mentioned heretofore and many novel features that result in a golf wind indicator flag which is not anticipated, rendered obvious, suggested, or even implied by any of the prior art indicating devices, either alone or in any combination thereof.

To attain this, the present invention generally comprises a flag for indicating wind velocity and alerting surrounding golfers to a presence of an individual. The inventive device includes a mounting assembly for securing to a support portion of a golf cart or golf bag. A flag assembly projects from the mounting assembly and includes a pivotally mounted flag for indicating wind direction. A gauge assembly is attached to a portion of the flag assembly and spaced from the mounting assembly for indicating a velocity of the wind.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf wind indicator flag apparatus and method which has many of the advantages of the indicating devices mentioned heretofore and many novel features that result in a golf wind indicator flag which is not anticipated, rendered obvious, suggested, or even implied by any of the prior an tool guides, either alone or in any combination thereof.

It is another object of the present invention to provide a new golf wind indicator flag which may be easily and efficiently manufactured and marketed.

It is a further object of the present invention to provide a new golf wind indicator flag which is of a durable and reliable construction.

An even further object of the present invention is to provide a new golf wind indicator flag which is susceptible of a low cost of manufacture with regard to both materials and labor, and which accordingly is then susceptible of low prices of sale to the consuming public, thereby making such golf wind indicator flags economically available to the buying public.

Still yet another object of the present invention is to provide a new golf wind indicator flag which provides in the apparatuses and methods of the prior art some of the advantages thereof, while simultaneously overcoming some of the disadvantages normally associated therewith.

Still another object of the present invention is to provide a new golf wind indicator flag for indicating wind velocity and alerting surrounding golfers to a presence of an individual golfer.

Yet another object of the present invention is to provide a new golf wind indicator flag which includes a mounting assembly for securing to a support portion of a golf cart or golf bag, a flag assembly projecting from the mounting assembly and including a pivotally mounted flag for indicating wind direction, and a gauge assembly interposed between the flag assembly and the mounting assembly for indicating a velocity of the wind.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
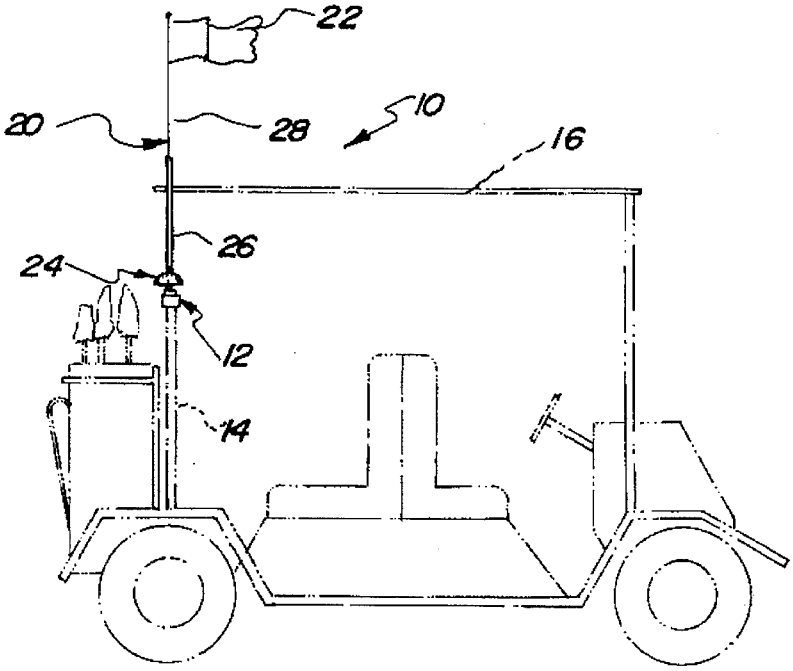
FIG. 1 is an elevation view of a golf wind indicator flag according to the present invention in use.

With reference now to the drawings, and in particular to FIGS. 1–8 thereof, a new golf wind indicator flag embodying the principles and concepts of the present invention and generally designated by the reference numeral 10 will be described.

Figure 2:
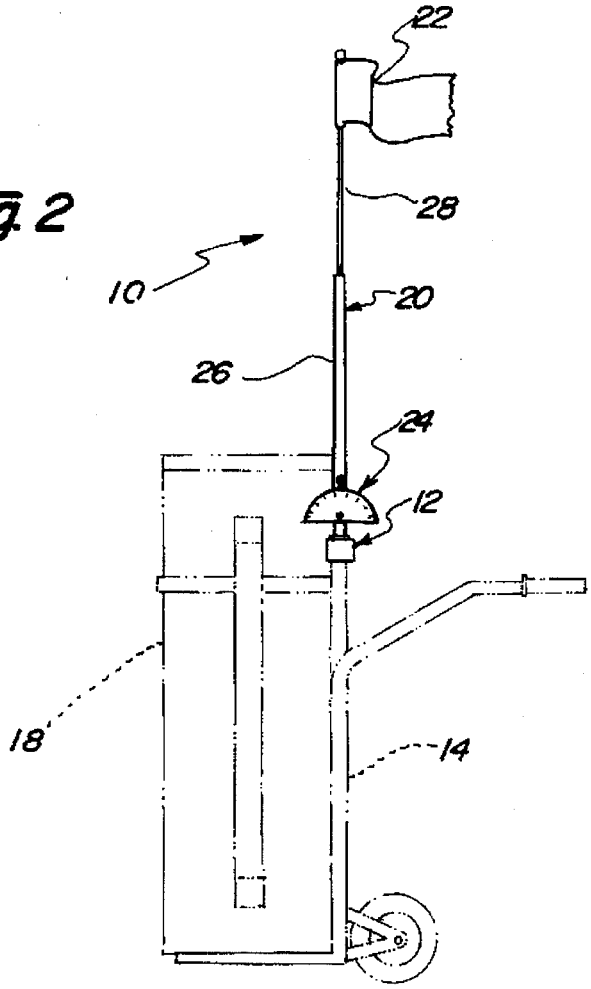
FIG. 2 is an elevation view of the golf wind indicator flag of the invention in an alternative use.

More specifically, it will be noted that the golf wind indicator flag 10 comprises a mounting means 12 for securing to a support portion 14 of a golf cart 16, as shown in FIG. 1 of the drawings, or a golf bag 18 as shown in FIG. 2 of the drawings. A flag assembly 20 is rotatably mounted relative to the mounting means 12 and includes a pivotally mounted flag 22 which is free to rotate about a vertical axis so as to indicate a direction of wind during use of the device 10. A gauge means 24 is attached to a portion of the flag assembly 20 and spaced from the mounting means 12 and permits the flag assembly 20 to articulate relative to the mounting means 12 for indicating a velocity of wind engaging the flag 22. By this structure, an individual golfer can ascertain both a direction and a velocity of wind during play of a golf game upon a golf course. Further, the flag 22 serves to indicate to surrounding individuals a presence of the golf cart 16 or golf bag 18 and the associated golfer.

Figure 3:
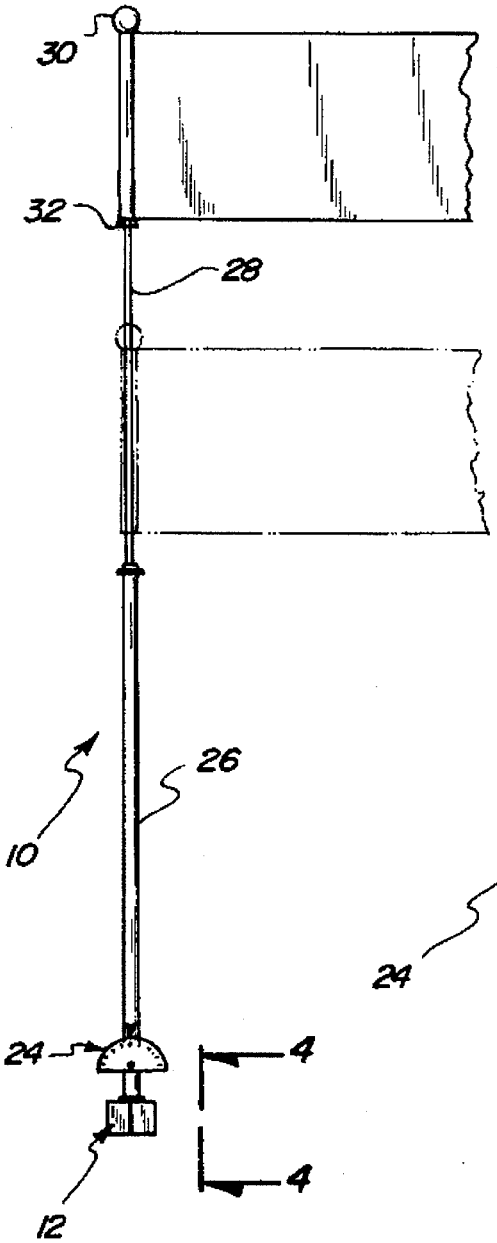
FIG. 3 is an elevation view of the present invention, per se.

As best illustrated in FIGS. 1 through 3, it can be shown that the flag assembly 20 of the present invention 10 preferably comprises a substantially hollow base tube 26 projecting from the gauge means 24 and receiving a telescoping member 28 within the base tube 26. An exterior surface of the telescoping member 28 is frictionally engaged to an interior surface of the base tube 26 so as to retain the telescoping member 28 in a desired axial position when extended from the base tube 26. The flag 22 is rotatably mounted to the upper end of the telescoping member 28 and is supported between an upper stop 30 secured to an uppermost end of the telescoping member 28 and a lower stop 32. By this structure, the telescoping member 28 can be selectively extended or retracted relative to the base tube 26 during use and/or storage of the device 10.

Figure 4:
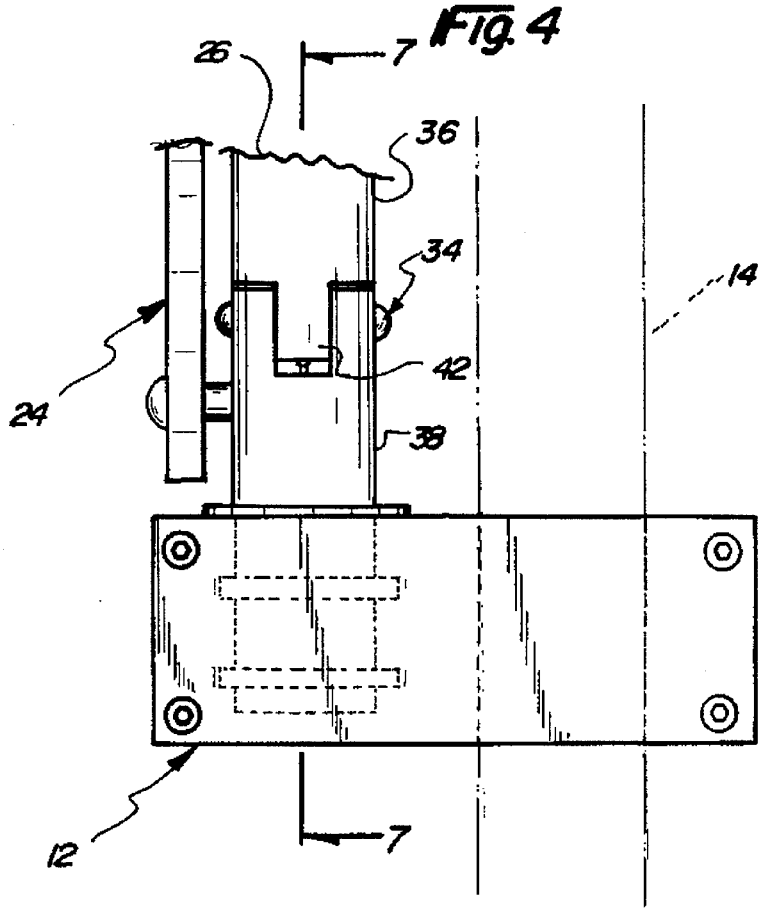
FIG. 4 is a side elevation view taken along line 4—4 of FIG. 3.
Figure 7:
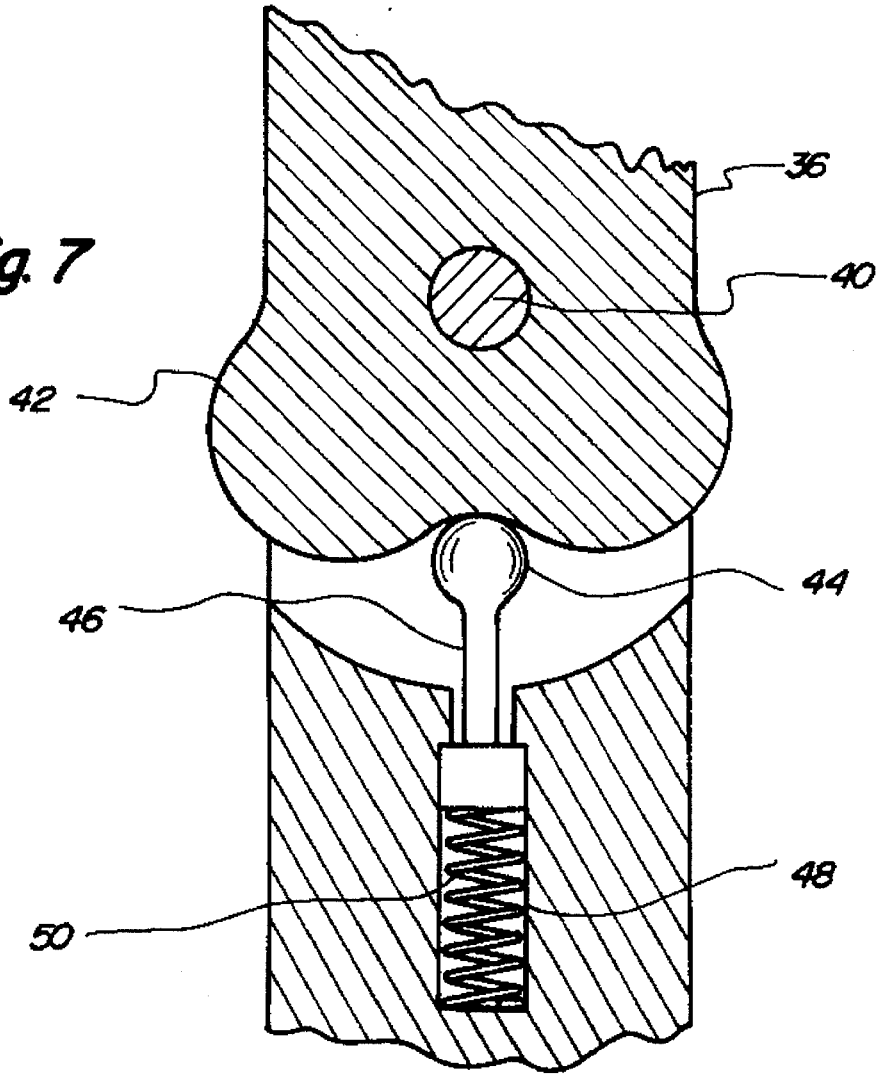
FIG. 7 is a cross-sectional view taken along line 7—7 of FIG. 4.
Figure 8:
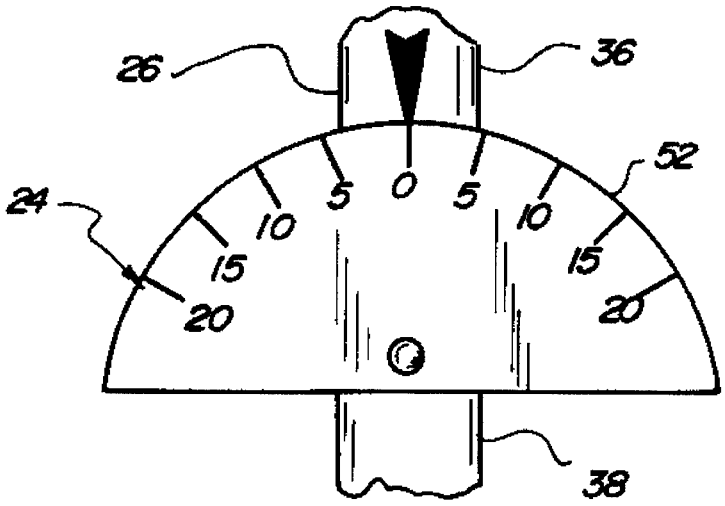
FIG. 8 is an elevation view of a gauge means comprising a portion of the present invention.

Referring now to FIGS. 4, 7, and 8, it can be shown that the gauge means 24 of the present invention 10 preferably comprises a pivotal coupling 34 separating the base tube 26 into an upper portion 36 and a lower portion 38. To this end, the pivotal coupling 34 comprises a pivot pin 40 directed through the portions 36 and 38 so as to pivotally couple the portions of the base tube 26 together. The upper portion 36 of the base tube 26, as shown in FIG. 7, is shaped so as to define a cam 42 having laterally projecting lobes. A cam follower 44 engages the cam 42 and is supported by a plunger 46 received within a cylindrical bore 48 directed into the lower portion 38 of the base tube 26. A spring 50 is interposed between a closed end of the cylindrical bore 48 and the plunger 46 so as to bias the follower 44 into engagement with the cam 42. Normally, the follower 44 resides between the laterally spaced lobes of the cam 42 so as to support the upper portion 36 of the base tube 26 in a colinear orientation relative to the lower portion 38 thereof. However, as the flag 22 is aerodynamically biased by wind passing thereby, the upper portion 36 of the base tube 26 will pivot about the pivot pin 40, thereby causing one of the lobes of the cam 42 to engage the follower 44 and force the plunger 46 into the cylindrical bore 48 against a force of the spring 50. As shown in FIG. 8, the gauge means 24 further comprises a calibrated scale 52 mounted to the lower portion 38 of the base tube 26 which includes indicia printed thereon indicating a velocity of the wind in accordance with a degree of pivoting of the upper portion 36 of the base tube 26 relative to the lower portion 38 thereof. Preferably, the calibrated scale 52 indicates wind velocity in miles-per-hour (MPH). By this structure, an individual can readily ascertain a wind velocity during use of the device 10.

Figures 5, 6:
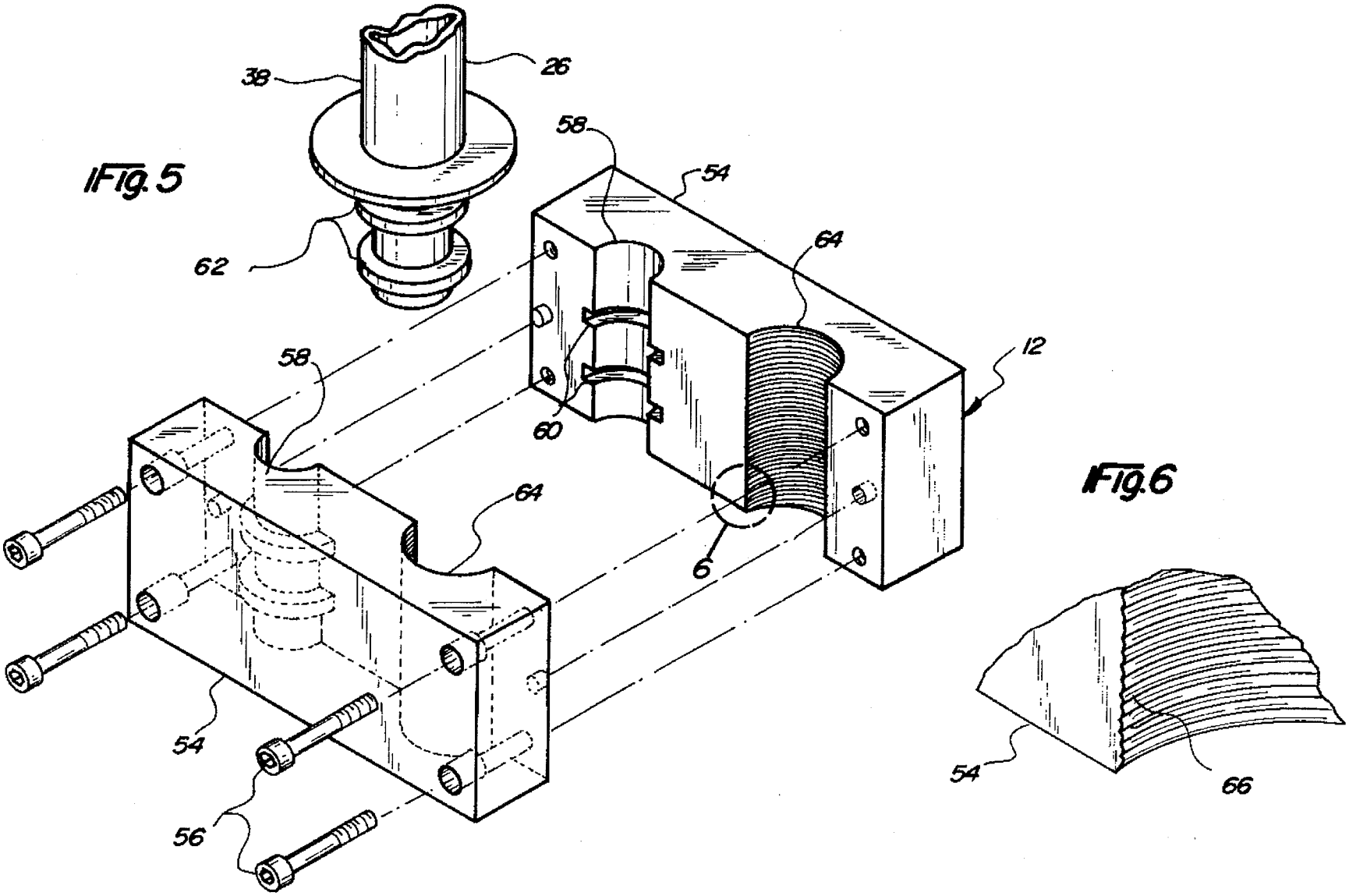
FIG. 5 is an exploded isometric illustration of a mounting means comprising a portion of the present invention.
FIG. 6 is an enlarged isometric illustration of the area set forth in FIG. 5.

Referring now to FIGS. 4 through 6, it can be shown that the mounting means 12 of the present invention 10 preferably comprises a substantially rectangular mounting block 54 comprised of separable halves removably secured together by fasteners 56 directed therebetween. The mounting block 54 is shaped so as to define a first cylindrical bore 58 directed therethrough having at least one annular groove 60 extending circumferentially about an interior surface of the cylindrical bore 58. The lower portion 38 of the base tube 26 is received within the first cylindrical bore 58 and includes at least one annular projection 62 which is cooperatively received within the annular groove 60 so as to rotatably couple the base tube 26 to the mounting block 54. To facilitate securement of the mounting block 54 to the support portion 14 of golf cart 16 or golf bag 18, the mounting block is further shaped so as to define a second cylindrical bore 64 directed therethrough which can be circumferentially positioned about the support portion in a desired orientation. As shown in FIG. 6, the second cylindrical bore 64 preferably includes a plurality of annular serrations 66 directed circumferentially about an interior surface of the second cylindrical bore for increasing a frictional engagement between the mounting block 54 and the support portion 14 of the cart 16 or bag 18 when the mounting means 12 is coupled thereto.

In use, the golf wind indicator flag 10 of the present invention can be easily utilized for indicating both a direction and a velocity of wind during play of a golfing game on a golf course. The present invention 10 further serves to alert surrounding golfers to a presence of the user of the device inasmuch as the flag 22 can be viewed from a position over a hill or other obstruction.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf wind indicator apparatus comprising:

a mounting means for securing to a support, the mounting means comprises a substantially rectangular mounting block including separable halves removably secured together by fasteners directed therebetween, the mounting block being shaped so as to define a first cylindrical bore directed therethrough having at least one annular groove extending circumferentially about an interior surface of the cylindrical bore, the mounting block being further shaped so as to define a second cylindrical bore directed therethrough which can be circumferentially positioned about the support in a desired orientation;

the second cylindrical bore includes a plurality of annular serrations directed circumferentially about an interior surface of the second cylindrical bore for increasing a frictional engagement between the mounting block and the support when the mounting block is coupled thereto;

a flag assembly including a pivotally mounted flag which is free to rotate about a vertical axis, the flag assembly comprises a substantially hollow base tube, the base tube having a telescoping member being received therein, the mounted flag being rotated by mounted to an upper end of the telescoping member, wherein the telescoping member can be selectively extended and retracted relative to the base tube;

a gauge means being attached to the flag assembly and spaced from the mounting means for indicating a velocity of wind engaging the flag, the gauge means allowing the substantially hollow base tube of the flag assembly to project therefrom, the gauge means comprises a pivotal coupling separating the base tube into an upper portion and a lower portion, with the lower portion of the base tube being received within the first cylindrical bore and including at least one annular projection which is cooperatively received within the annular groove so as to rotatably couple the base tube to the mounting block, the upper portion of the base tube being shaped so as to define a cam having laterally spaced projecting lobes, with the lower portion of the base tube being shaped so as to define a cylindrical bore directed thereinto; a cam follower engaging the cam; a plunger coupled to the follower and received within the cylindrical bore of the lower portion of the base tube; a spring interposed between a closed end of the cylindrical bore and the plunger so as to bias the follower into engagement with the cam, wherein the follower normally resides between the laterally spaced projecting lobes of the cam so as to support the upper portion of the base tube in a collinear orientation relative to the lower portion thereof;

the gauge means further comprises a calibrated scale mounted to the lower portion of the base tube which includes indicia printed thereon indicating a velocity of the wind in accordance with a degree of pivoting of the upper portion of the base tube relative to the lower portion thereof; and the pivotal coupling comprises a pivot pin directed through the portions of the base tube so as to pivotally couple the portions of the base tube together,

2. A golf wind indicator apparatus comprising:

a golf cart having a vertically projecting support;

a mounting means secured to the support, the mounting means comprises a substantially rectangular mounting block including separable halves removably secured together by fasteners directed therebetween, the mounting block being shaped so as to define a first cylindrical bore directed therethrough having at least one annular groove extending circumferentially about an interior surface of the cylindrical bore, the mounting block being further shaped so as to define a second cylindrical bore directed therethrough which is circumferentially positioned about the support in a desired orientation;

the second cylindrical bore includes a plurality of annular serrations directed circumferentially about an interior surface of the second cylindrical bore for increasing a frictional engagement between the mounting block and the support;

a flag assembly including a pivotally mounted flag which is free to rotate about a vertical axis the flag assembly comprising a substantially hollow base tube and a telescoping member received within the base tube, the flag being rotatably mounted to an upper end of the telescoping member, wherein the telescoping member can be selectively extended and retracted relative to the base tube;

a gauge means being attached to the flag assembly and spaced from the mounting means for indicating a velocity of wind engaging the flag, the gauge means comprises a pivotal coupling separating the base tube into an upper portion and a lower portion with the lower portion of the base tube being received within the first cylindrical bore and including at least one annular projection which is cooperatively received within the annular groove so as to rotatably couple the base tube to the mounting block, the upper portion of the base tube being shaped so as to define a cam having laterally spaced projecting lobes, with the lower portion of the base tube being shaped so as to define a cylindrical bore directed thereinto; a cam follower engaging the cam; a plunger coupled to the follower and received within the cylinder bore of the lower portion of the base tube; a spring interposed between a closed end of cylindrical bore and the plunger so as to bias the follower into engagement with the cam, wherein the follower normally resides between the laterally spaced projecting lobes of the cam so as to support the upper portion of the base tube in a collinear orientation relative to the lower portion thereof;

the gauge means further comprises a calibrated scale mounted to the lower portion of the base tube which includes indicia printed thereon indicating velocity of the wind in accordance with a degree of pivoting of the upper portion of the base tube relative to the lower portion thereof; and the pivotal coupling comprises a pivot pin directed through the portions of the base tube so as to pivotally couple the portions of the base tube together.

3. A golf wind indicator apparatus comprising:

a golf bag having a vertically projecting support;

a mounting means secured to the support;

a flag assembly rotatably mounted to the mounting means and including a pivotally mounted flag which is free to rotate about a vertical axis, the flag assembly comprising a substantially hollow base tube, a telescoping member received within the base tube, the flag being rotatably mounted to an upper end of the telescoping member, wherein the telescoping member can be selectively extended and retracted relative to the base tube;

a gauge means being attached to the flag assembly and spaced from the mounting means for indicating a velocity of wind engaging the flag, the gauge means having the substantially hollow base tube projecting therefrom; and the gauge means comprises a pivotal coupling separating the base tube into an upper portion and a lower portion, the upper portion of the base tube being shaped so as to define a cam having a laterally spaced projecting lobes, with the lower portion of the base tube being shaped so as to define a cylindrical bore directed thereto, a cam follower engaging the cam; a plunger coupled to the follower and received within the cylindrical bore of the lower portion of the base tube; a spring interposed between a closed end of the cylindrical bore and the plunger so as to bias the follower into engagement with the cam, wherein the follower normally resides between the laterally spaced projecting lobes of the cam so as to support the upper portion of the base tube in a collinear orientation relative to the lower portion thereof.

4. The golf wind indicator flag of claim 3, wherein the gauge means further comprises a calibrated scale mounted to the lower portion of the base tube which includes indicia printed thereon indicating a velocity of the wind in accordance with a degree of pivoting of the upper portion of the base tube relative to the lower portion thereof.

5. The golf wind indicator flag of claim 4, wherein the pivotal coupling comprises a pivot pin directed through the portions of the base tube so as to pivotally couple the portions of the base tube together.

6. The golf wind indicator flag of claim 5, wherein the mounting means comprises a substantially rectangular mounting block including separable halves removably secured together by fasteners directed therebetween, the mounting block being shaped so as to define a first cylindrical bore directed therethrough having at least one annular groove extending circumferentially about an interior surface of the cylindrical bore, with the lower portion of the base tube being received within the first cylindrical bore and including at least one annular projection which is cooperatively received within the annular groove so as to rotatably couple the base tube to the mounting block, the mounting block being further shaped so as to define a second cylindrical bore directed therethrough which is circumferentially positioned about the support.

* * * * *